United States Patent [19]

Rabatin

[11] Patent Number: 4,510,843

[45] Date of Patent: Apr. 16, 1985

[54] SOUND SUPPRESSOR ATTACHING DEVICE FOR GUNS

[76] Inventor: Robert U. Rabatin, 11181 Fairlawn Dr., Parma, Ohio 44130

[21] Appl. No.: 525,934

[22] Filed: Aug. 24, 1983

[51] Int. Cl.[3] ..... F41C 21/18

[52] U.S. Cl. ..... 89/14.4

[58] Field of Search ..... 42/79; 89/14 R, 14 B, 89/14 C, 14 D, 14 E, 14 SB; 181/223

[56] References Cited

U.S. PATENT DOCUMENTS

| | | | |
|---|---|---|---|
| 2,953,972 | 9/1960 | Sorensen | 89/14 C |
| 3,710,679 | 1/1973 | Werbell | 89/14 D |
| 3,732,776 | 5/1973 | Snodgrass | 89/14 E |

*Primary Examiner*—Stephen C. Bentley

*Attorney, Agent, or Firm*—John M. Romanchik, Jr.

[57] ABSTRACT

A cam operated attaching device for quickly attaching and removing a sound suppressor to a gun barrel, comprising a segmented collet with lugs on the internal side of the segment tips which engage circular grooves in the outer periphery of a nipple fastened to the gun barrel end.

6 Claims, 3 Drawing Figures

SOUND SUPPRESSOR ATTACHING DEVICE FOR GUNS

BACKGROUND OF THE INVENTION

This invention relates to an attaching device for quickly attaching or removing a sound suppressor from a gun.

Previously, guns utilized noise suppressors that were affixed to a flash suppressor which was screwed to the end of a gun barrel on threads. Removal of the noise suppressor also required removal of the flash suppressor. Since the flash suppressor is removed by unscrewing it from the threads on the end of the gun barrel, this would then leave the threads on the gun barrel end exposed to damage from banging against other hard objects.

The present invention overcomes this problem of the prior art by providing a device having a quick means of attaching and detaching the noise suppressor from a threaded nipple screwed on to the gun barrel end. When the noise suppressor is removed, the nipple remains screwed to the gun barrel thus preventing exposure of the threads machined on the gun barrel end to damage. Further advantages over the prior art are the simplicity in operating the device, the quickness in attachment and removal and the simple structural design which facilitates easy manufacturing.

SUMMARY OF THE INVENTION

In accordance with the present invention, there is provided an improved attachment device for attaching a sound suppressor to the end of gun barrel comprising a cam operated, segmented collet having lugs on the internal side of the segment tips that engage circular grooves formed in a connecting nipple. The segments are heat treated to have spring characteristics and are resiliently pressed into engaging relationship with the segment lugs seating in grooves in the connecting nipple by action of a cam machined on the inner portion of a locking collar as the collar is advanced on threads on the collet. When the collar is unscrewed in the reverse direction, the collet segments spring away from engagement with the connecting nipple grooves and releases the device for removal of the noise suppressor by one quick pull away from the gun barrel end.

Accordingly it is a principle object of the invention to provide an improved sound suppressor attaching device for guns which is simple yet reliable in obtaining a positive locked engagement.

It is a further object of the invention to provide an attaching device for guns which is simple, effective and inexpensive to manufacture.

Another object of the invention is to provide an attaching device that permits quick connection of a sound suppressor to a gun.

Yet another object of the invention is to provide an attachment device that utilizes a minimum of parts.

A still further object of the invention is to provide an attaching device that is simple to operate and does not require any tools in the field.

Other objects and advantages of the invention will appear from the following detailed description of preferred embodiments of the invention, reference being made to the accompanying drawings.

DETAILED DESCRIPTION OF THE INVENTION

Figure 1:
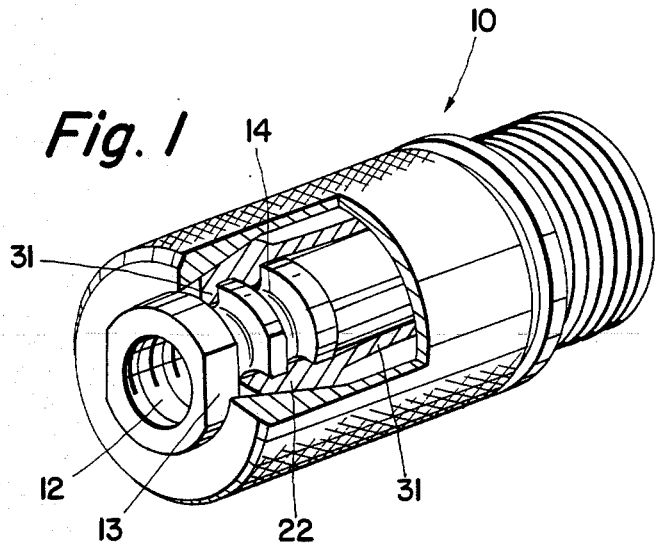
FIG. 1 is a perspective view broken away in part of the device according to invention.

Referring to FIG. 1, there is illustrated the sound suppressor attachment device of the invention shown generally at 10. The device is formed of three tubular sections, a locking cam nut 20, a connecting nipple 11 and a collet 30 which operate in cooperation to form the attachment device assembly 10. The device 10 is adapted for use with various guns especially United States military weapons such as the M-16A1 rifle, XM-177 rifle, Colt AR-15 rifle, XM-231 machine gun and other arms particularly those utilizing a bird cage type flash suppressor. Connecting nipple 11 is a replacement or substitute for the presently existing flash suppressor in use with United States military weapons. The device is particularly designed to be used with present military arms without any modification whatsoever. The connecting nipple 11 shown in FIG. 2 matches the dimensions of currently existing flash suppressor issue and is permanently pre-attached to the M-16A1 military rifle by turning with a wrench applied to flats 13. Connecting nipple 11 is advanced on threads 12 which engage matching threads on the end of the M-16A1 rifle barrel until tightened so that it will not become loose as the user is not required to carry a wrence in the field.

Figure 3:
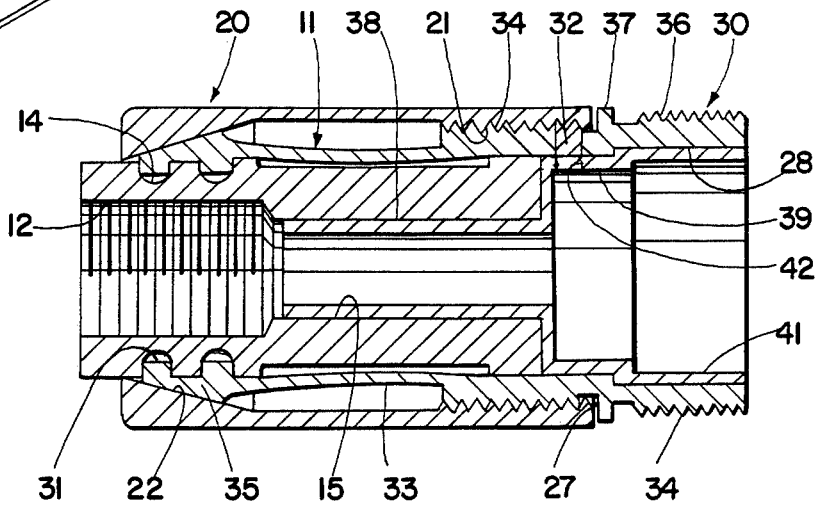
FIG. 3 is an axial cross section of the device of FIG. 1 in the assembled position.

Connecting nipple 11 has machined circular grooves 14 and 15 formed around the outer periphery as shown in the drawings. Collet 30 has lugs 31, 32 machined on the inside tips of segments 33. The lugs 31, 32 engage connecting nipple grooves 14, 15 for locking the device 10 and centering it on the rifle end as shown in FIGS. 1 and 3. Two rows of lugs 31, 32 are preferred for stronger locking although one may suffice.

Locking cam nut 20 has threads 21 at one end for engaging matching threads 34 on collet 30. Cam 22 is applied to the cam 35 on the collet 30 when the locking nut 20 is advanced on collet 30 by hand turning locking nut 20 by gripping the knurled 23 outer surface. The threads 21 of locking nut 20 advance on threads 34 of collet 30 and cause cam surface 22 to press the collet 30 segments 33 inward by engaging cam surface 35 on the tips of segments 33. Lugs 31, 32 are thereby pressed into locking relationship with grooves 14, 15 on connecting nipple 11. A locking plug 32 which is made of fiber or nylon material is embedded in threads 34 of collet 30 to prevent loosening of locking cam nut 20 when screwed onto collet 30. Expending gasses passing through the device apply great pressure to the bottom of cylindrical locking plug 32. Pressing it with tremendous force against threads 21 of locking cam nut 20 thus preventing locking cam nut 20 from loosening on collet 30. Collet segments 33, separated by slits 26, are heat treated to form springs which resiliently press against the inside of locking nut 20 and threads 21 to prevent locking nut 20 from separating and becoming lost in the field from said device 10.

Figure 2:
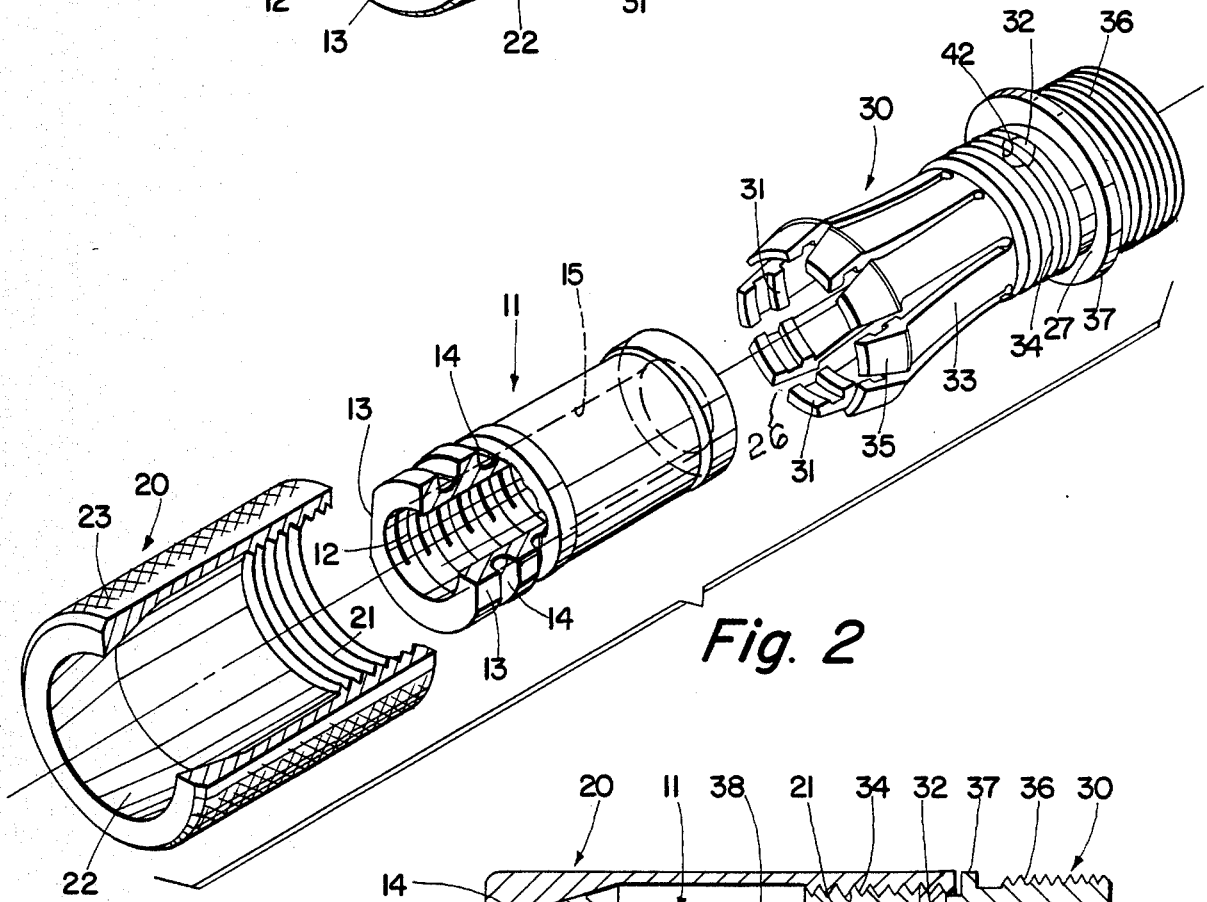
FIG. 2 is an exploded perspective view thereof.

A stop collar 37 is machined on collet 30 as shown in FIG. 2 and FIG. 3 to limit the advance of sound suppressor tube not shown. Collet threads 36 are utilized to attach a sound suppressor tube but can be adapted to attach other auxilliary equipment such as a grenade launcher.

All parts described herein are generally tubular and machined from bar stock steel of the grade commonly used for manufacturing weapons. The steel has to withstand the high temperature heat generated by burning or exploding gunpowder passing through the device. A gas tube 38 for transmitting gun powder gas is shown in FIG. 3 and is machined to a close tolerance that will permit a tight press fit within collet bore 28. The gas tube has a small section 38 and has a mid section 39 of larger diameter. An end section 41 is of slightly larger diameter than mid section 39 to provide a shoulder to contact collet bore stop shown at 27. This permits properly locating the machined gas tube in axial alligment with the gun when press fitted within collet 30 in a position to transmit gun powder gases through the device to an attached sound suppressor and sealed to present leakage.

Thus it can be appreciated that the devise illustrated can be readily utilized for quickly attaching a sound suppressor to a connecting nipple 11 which is previously mounted on a gun. The device 10 can easily be dimensioned to fit all sizes of military weapons currently in use. The device 10 is quickly fastened to nipple 11 without requiring any tools. Military personnel in the field are therefore not required to carry extra equipment but by merely applying hand power can quickly attach and detach sound suppressors or other ordinances from the weapon through the employment of the present invention. Further, it can be seen there are no loose parts that can be lost. The collet 30 remains connected to a sound suppressor by threads 36 and locking nut 20 is retained on collet 30 by the outward spring tension of segments 33 pressing against the inside bore of locking nut 20 and threads 21.

While specific embodiments of the invention have been described and illustrated, it is to be understood that these embodiments are provided by way of example only and that the invention is not to be construed as being limited thereto, but only by the proper scope of the following claims.

I claim:

1. A gun sound suppressor attaching device comprising a tubular connecting nipple, means for attaching said nipple to a gun barrel end, said nipple having at least one circular groove formed in one end, a generally tubular collet, means to attach said collet to a sound suppressor at one end, a plurality of elongated segments at the other end of said collet with each segment separated by a slit from each other, at least one row of lug members formed on the inward side of each segment tip for seating in said connecting nipple circular groove, said tips have a cam surface on the outward side opposite said lugs, a cylindrical tube centrally formed within said collet extending axially in alignment with said gun barrel end for sealing and transmitting gas emission from said gun through said device, and a tubular cam locking nut for inserting around said collet, means at one end of said locking nut for locking to said collet, a cam at the other end formed on the inward side of said nut for engaging said cams on said collet segment tips for pressing said collet lug members into locking engagement with said nipple circular groove.

2. A gun sound suppressor attaching device as defined in claim 1 wherein said tubular collet, nipple and cam locking nut are cylindrical.

3. A gun sound suppressor attaching device as defined in claim 2 wherein said segments are leaf springs for retaining said cam locking nut from separating.

4. A gun sound suppressor attaching device as defined in claim 3 wherein said means for attaching nipple to said gun barrel end, said means for attaching said collet to the sound suppressor, and said means for attaching said cam locking nut are threads for attaching and locking said device together.

5. A gun sound suppressor attaching device as defined in claim 4 wherein said collet threads include a locking plug to prevent loosening.

6. A gun sound suppressor attaching device as defined in claim 5 wherein said cam locking nut outer surface is knurled for gripping by hand and tightening and locking said nut to said collet.

* * * * *